US009586750B1

(12) United States Patent
Mangold

(10) Patent No.: US 9,586,750 B1
(45) Date of Patent: Mar. 7, 2017

(54) PISTOL STYLE SPRAY HEAD

(71) Applicant: Steve Mangold, Rexford, MT (US)

(72) Inventor: Steve Mangold, Rexford, MT (US)

( * ) Notice: Subject to any disclaimer, the term of this patent is extended or adjusted under 35 U.S.C. 154(b) by 0 days.

(21) Appl. No.: 14/731,341

(22) Filed: Jun. 4, 2015

Related U.S. Application Data

(60) Provisional application No. 62/007,497, filed on Jun. 4, 2014.

(51) Int. Cl.

| | |
|---|---|
| ***B65D 83/14*** | (2006.01) |
| ***B65D 83/22*** | (2006.01) |
| ***F41H 9/10*** | (2006.01) |
| ***B65D 83/20*** | (2006.01) |

(52) U.S. Cl.
CPC ..... *B65D 83/22* (2013.01); *B65D 83/206* (2013.01); *F41H 9/10* (2013.01)

(58) Field of Classification Search
CPC ..... B65D 83/206; B65D 83/22; F41H 9/10
See application file for complete search history.

(56) References Cited

U.S. PATENT DOCUMENTS

| | | | | |
|---|---|---|---|---|
| 4,449,647 | A | 5/1984 | Reed et al. | |
| 4,805,812 | A * | 2/1989 | Brody | B65D 83/22 222/402.11 |
| 5,086,954 | A | 2/1992 | Brody | |
| 5,397,029 | A * | 3/1995 | West | F41H 9/10 222/153.01 |
| 5,775,432 | A * | 7/1998 | Burns | A62C 17/00 169/74 |
| 5,819,985 | A | 10/1998 | Brody | |
| 6,196,419 | B1 * | 3/2001 | Haney | B65D 83/202 222/153.03 |
| 7,249,692 | B2 * | 7/2007 | Walters | B05B 11/3014 222/153.11 |
| 7,316,334 | B1 * | 1/2008 | Brody | B65D 83/202 222/153.09 |
| 8,356,734 | B2 | 1/2013 | Oshimo et al. | |
| 8,556,125 | B2 | 10/2013 | Dapper | |
| 2003/0106545 | A1 * | 6/2003 | Verini | F41B 11/62 124/74 |
| 2004/0118028 | A1 * | 6/2004 | Bauer | F41H 9/10 42/1.08 |
| 2010/0237103 | A1 * | 9/2010 | Habermann | F41H 9/10 222/183 |

* cited by examiner

*Primary Examiner* — Frederick C Nicolas
*Assistant Examiner* — Bob Zadeh
(74) *Attorney, Agent, or Firm* — Jean Kyle

(57) ABSTRACT

A trigger mechanism rocks within a housing to activate pressurized spray. The trigger assembly has a stabilizing bar below the trigger finger guard to steady the pistol style spray head and provide a smooth pull. A trigger block inserted into the trigger finger guard and around the trigger pull provides a first safety mechanism. A thumb tab much like a safety on a rifle is a second safety mechanism.

20 Claims, 6 Drawing Sheets

PISTOL STYLE SPRAY HEAD

CROSS-REFERENCE TO RELATED APPLICATIONS

This application claims the benefits of U.S. Provisional Application No. 62/007,497, filed Jun. 4, 2014, the disclosure of which is hereby incorporated by reference in its entirety including all figures, tables and drawings.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

A pistol's intuitive appearance and general function are familiar to almost everyone. At an early age, children often have toy squirt guns with the familiar pistol design. Personal care products and cleaning solutions commonly have simple triggers yet their trigger assemblies lack full pistol features, such as multiple safeties, lower control grip tab, and a trigger guard (see, for example, U.S. Pat. Nos. 4,449,647; 4,805,812; 5,086,954; 5,819,985; 7,249,692; 7,316,334 B1; and 8,556,125 B2). A trigger type sprayer could supply the speed and accuracy needed in high danger situations such as using bear spray in self-defense and pepper spray in law enforcement. Currently however these markets have only thumb activated devices which are awkward, tilting from side to side when depressed, or are bulky and slow to activate. A need remains for a spray head for bear defense, home defense, or law enforcement with an intuitive design, that can deliver the high volume discharge rates required for each application.

All patents, patent applications, provisional patent applications and publications referred to or cited herein, are incorporated by reference in their entirety to the extent they are not inconsistent with the teachings of the specification.

BRIEF SUMMARY OF THE INVENTION

A pistol style spray head for a pressurized spray canister provides the user a firm and controlled grip to allow accurate application. Two safety mechanisms insure the spray is only dispensed when intended. A stabilizing brace insures the user a strong grip. The pistol style spray head has a housing configured to activate the release of the pressurized spray by pulling a trigger rockably suspended in the housing. A trigger block prevents the trigger from moving during storage and transport and is removed to fire. A sliding safety thumb tab also must be in the fire position to release the pressurized spray.

DETAILED DESCRIPTION OF THE INVENTION

Figure 1:
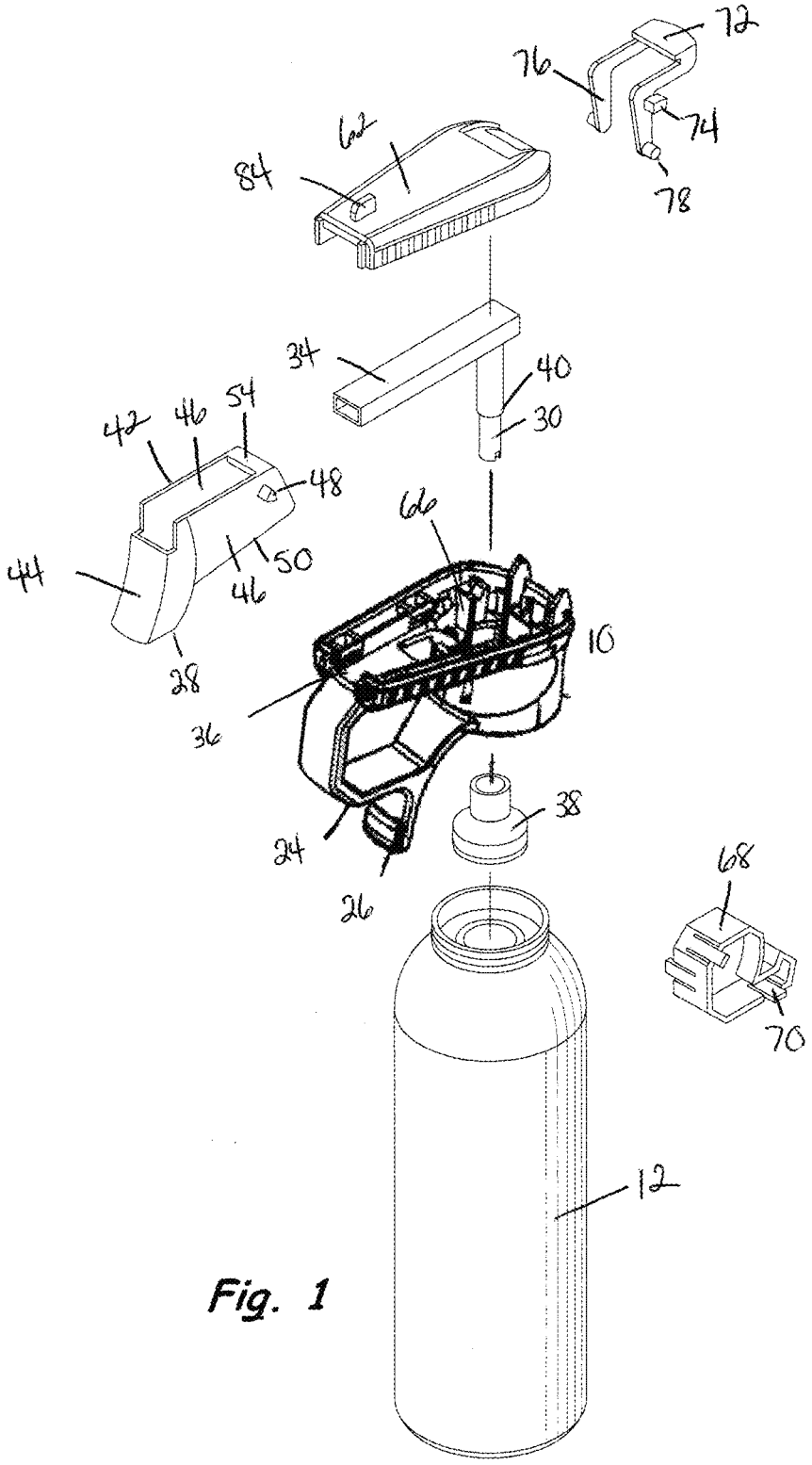
FIG. 1 is an exploded view of a preferred embodiment of the pistol style spray head of the subject invention.

The invention involves a pistol style spray head to activate pressurized gas such as pepper or bear spray. The pistol style spray head has two safety mechanisms and a stabilizing brace to insure a certain shot.

A preferred embodiment of the pistol style spray head is shown in FIGS. 1-8. In this embodiment, a trigger housing 10 connects the spray head to the spray canister, creates the trigger assembly, and supports the two safety mechanisms of the pistol style spray head of the subject invention.

The trigger housing 10 engages the pressurized spray canister 12 through canister engagement means 14 to connect the trigger assembly to the canister. In the exemplified embodiment, the pistol style spray head is configured for use on a pepper spray or bear spray canister. Although the subject device is described for use on a pepper spray canister, it is noted that the pistol style spray head of the subject invention can be configured to be used on any canister of pressurized gas or liquid. As shown in the exemplified drawings, a skirt 16 of the housing of the pistol style spray head surrounds the rolled collar 18 of the canister. Resilient fingers 20 hold the housing to the canister. Although the configuration of canisters is relatively consistent and the specifics required to snap the housing into the rolled collar of the canister are well known in the art, it is also recognized that other means by which the housing could be connected to the same type of canister or a canister of a different configuration would be apparent to one skilled in the art. It is only necessary that these means 14 secure the housing to the canister in such a manner as to prevent any movement of the housing when the trigger of the spray head is pulled.

Figure 2:
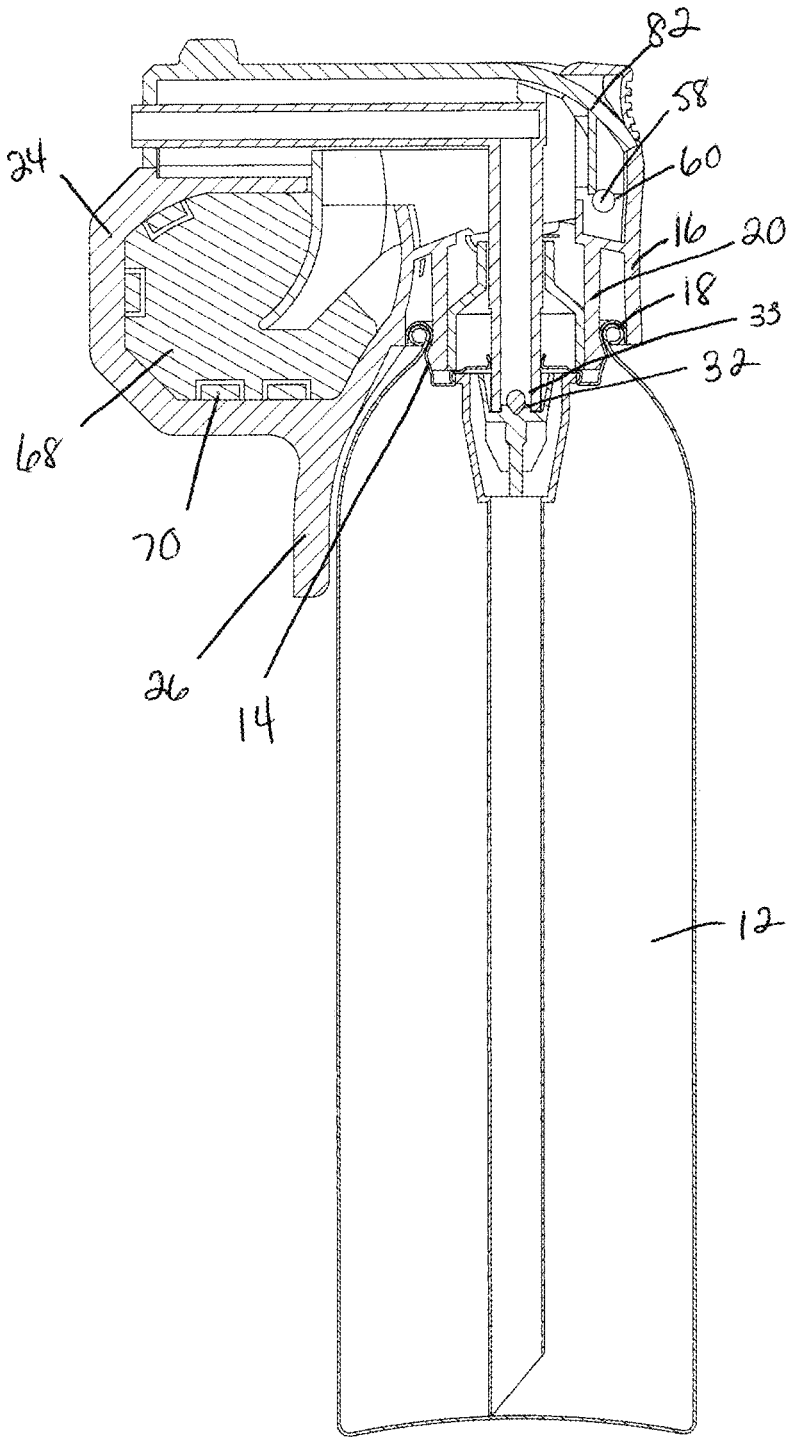
FIG. 2 is a cross-sectional view of a preferred embodiment of the pistol style spray head of the subject invention with the trigger block in the trigger opening.
Figure 3:
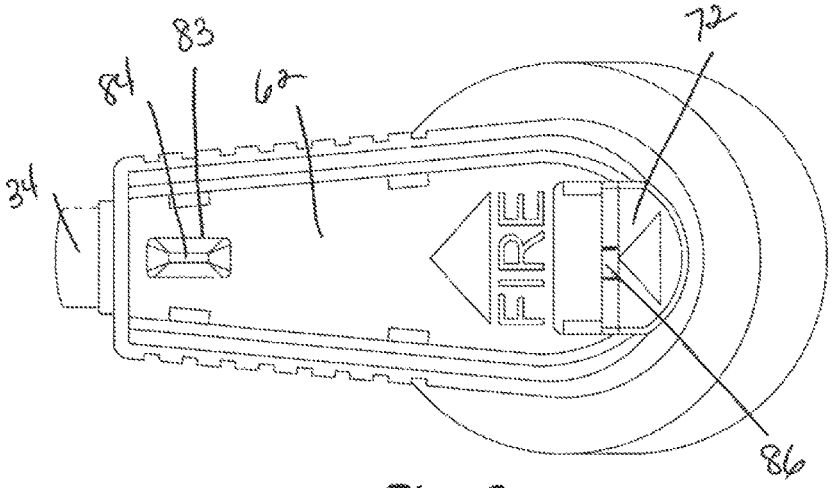
FIG. 3 is top plan view of a preferred embodiment of the pistol style spray head of the subject invention with the thumb safety in the safe or on position.
Figure 4:
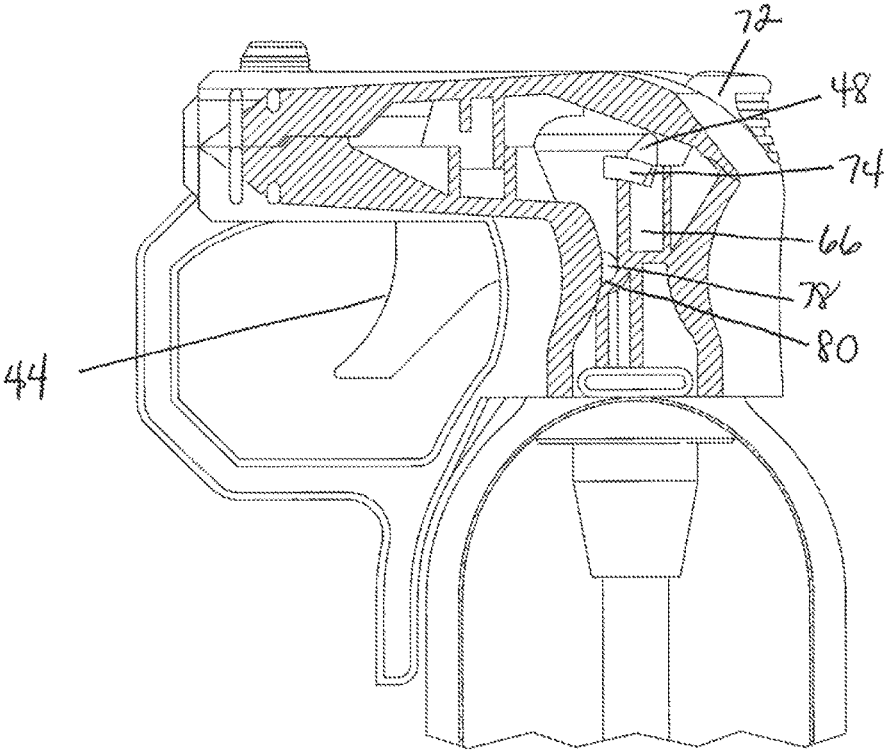
FIG. 4 is partial cut-away view of a preferred embodiment of the pistol style spray head of the subject invention with the thumb safety on safe.
Figure 5:
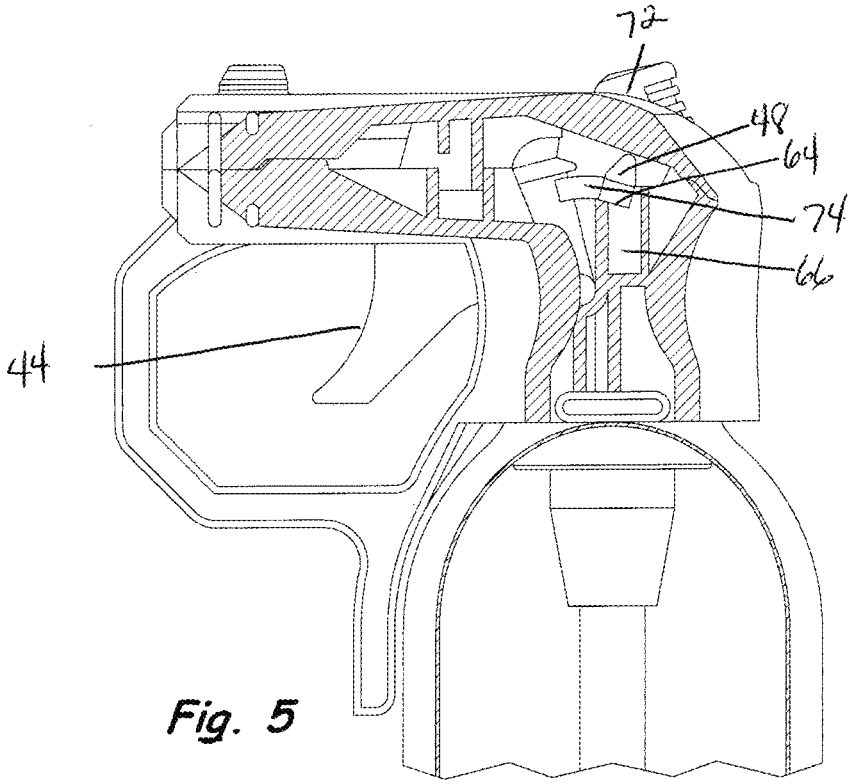
FIG. 5 is partial cut-away view of a preferred embodiment of the pistol style spray head of the subject invention with the thumb safety in the off or fire position.
Figure 6:
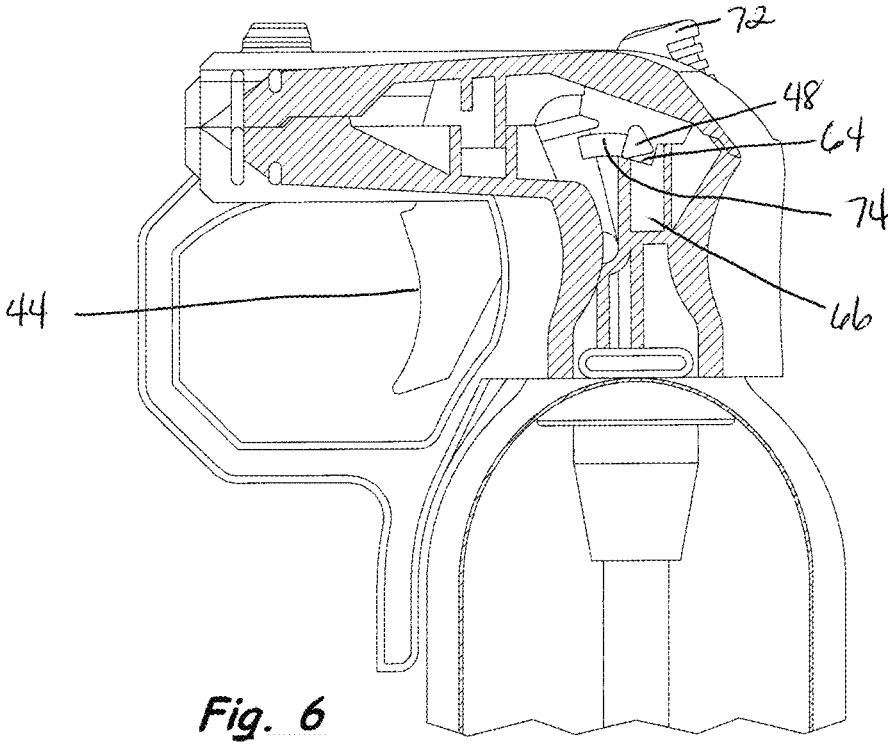
FIG. 6 is partial cut-away view of a preferred embodiment of the pistol style spray head of the subject invention with the trigger pressed and firing pressurized spray.
Figure 7:
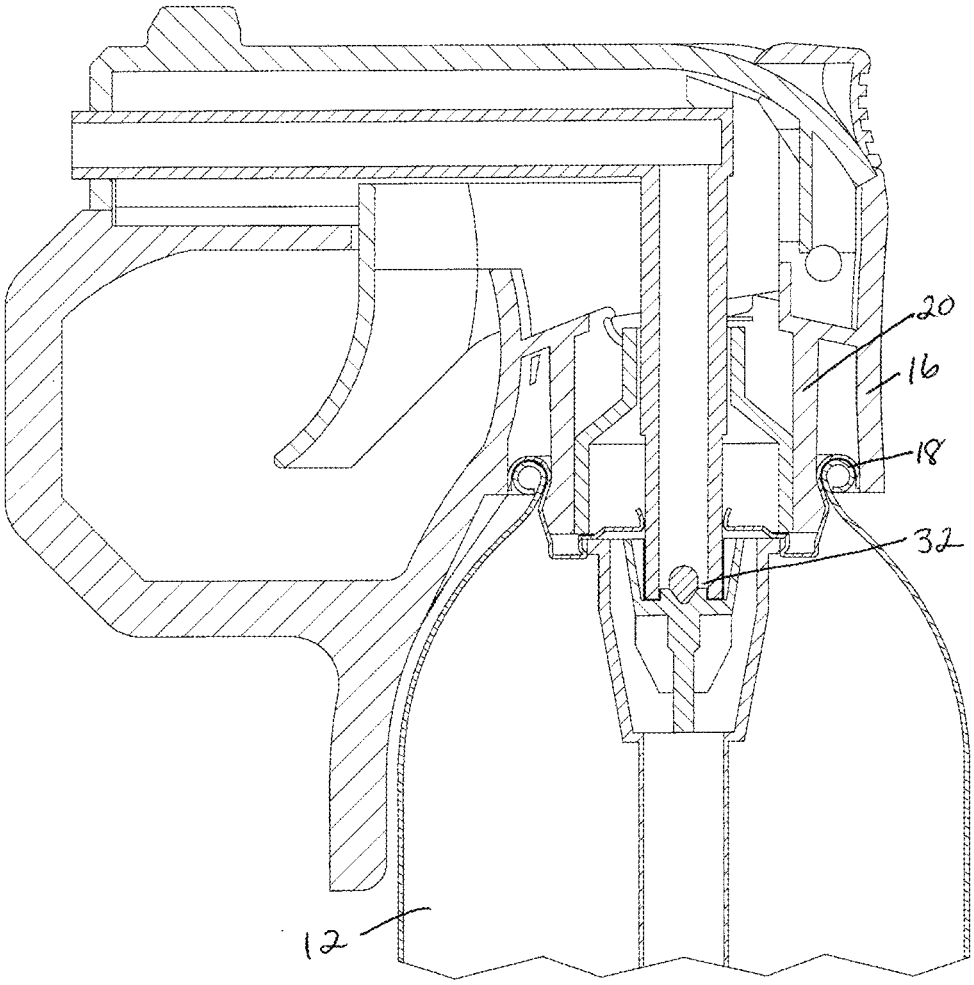
FIG. 7 is a partial side cross-sectional view of a preferred embodiment of the pistol style spray head of the subject invention.
Figure 8:
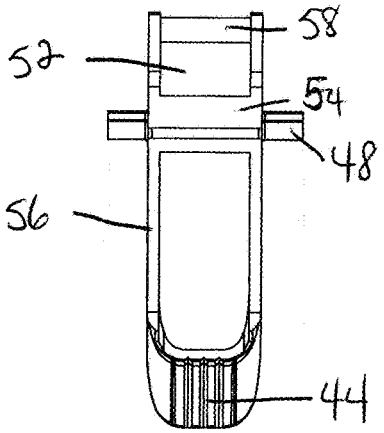
FIG. 8 is a top view of a preferred embodiment of the trigger box of the pistol style spray head of the subject invention.

The housing is also the frame 22 that supports and creates the trigger mechanism. The frame includes a trigger finger guard or brush guard 24 and a stabilizing brace 26. A user places the index finger inside the trigger finger guard to contact and pull the trigger 28. The stabilizing brace 26 extends from the bottom of the trigger finger guard 24 (FIG. 2). The user contacts the brace with his/her middle finger. Contact with the brace when pulling the trigger provides the user a smoother pull and better control.

The trigger 28 sits in the housing and rocks to activate spray release. A notched tube 30 engages the female valve 32 of the canister. A nozzle 34 of the pistol style spray head ushers the released spray through an opening 36 in the housing. Preferably, a retainer 38 positioned inside the canister throat holds the notched tube. A shoulder 40 on the notched tube is a rubber gasket that mates with the retainer to seal the system. The exemplified embodiment shows a trigger assembly configured to activate a canister with a female valve. It would be apparent to one skilled in the art how to configure the system to activate a canister with a male valve.

Various applications of bear or pepper spray require high volume discharge and stream configuration. The exemplified embodiment of the pistol style spray head of the subject invention is shown applied to canisters that provide a high volume discharge. The configuration of the nozzle and opening in the housing allow directional fittings to be inserted into the system so that the spray can be patterned. For example, spray applied in a fog wall has been proven most effective in bear defense. Law enforcement professionals may use a fog pattern to control crowds, while a cone pattern or stream would be used to target specific perpetrators. Application of the directional fittings to the nozzle tip allows the pistol style spray head of the subject invention to create such patterns. Changes to the stream pattern may also require modifications in valve type of the canister and tube and nozzle configuration. The adaptations that must be made to configure the pistol style spray head of the subject invention to present these differing stream patterns would be apparent to those skilled in the art.

A trigger box 42 sits within the housing. A pull portion 44 on the front of the trigger box engages the user's finger. Box sides 46 have spurs extending outward. The box bottom 50 and rear end 52 are open while a single bridge 54 spans the box top 56 near the open rear end of the box. A bar 58 on the bottom rear end of the box rests in a channel 60 in the housing. When assembled, the nozzle 34 is pushed through the rear of the box and out the front above the pull portion 44 and the nozzle and trigger box are dropped into the housing. A cap 62 on the housing holds the trigger box in place. When the trigger is pulled the spurs 48 rock down and onto shelves 64 that are on posts 66 within the housing. The downward movement of the trigger box causes the bridge to depress the notched tube causing release of spray from the canister.

The pistol style spray head of the subject invention has two safety mechanisms. The first is a trigger block 68. The trigger block is inserted in the finger guard 24 and surrounds the pull portion 44 of the trigger 28 to block the trigger from being pulled. The trigger block has resilient fingers 70 that push against the trigger finger guard to hold the block in place. The trigger block is in position when the product is shipped and sold to the consumer. The user can leave the block in place when carrying the canister to prevent inadvertent activation. The block is displaced by pushing two fingers into the block releasing the contact between it and the finger trigger guard. Removal of the block frees the trigger to move within the housing.

The second safety mechanism provided on the pistol style spray head of the subject invention is a thumb tab 72 similar to a safety for a rifle trigger. The tab is pushed forward to release the safety. The thumb tab safety of the subject invention is positioned atop at the rear of the housing so that it can be slid with the thumb of the user holding the canister. Pushing the thumb pad forward displaces pins 74 on the legs 76 of the safety mechanism from beneath the spurs 48 of the trigger 28. This clears the way for the trigger spurs to drop into the shelves on the posts 66 in the housing depressing the notched tube 30 activating the spray canister 12. The pins are positioned about in the middle of the legs of the safety mechanism which terminate in pivots 78 that sit in saddles 80 of the housing. In the exemplified embodiment, the rear of the housing has a slight curve 82. The thumb tab travels along this curve when switched from a safety on to a safety off position. The curve provides fluid movement to the tab and increases the path it moves to insure the pins fully evacuate the space between the spurs of the trigger and the shelves of the posts of the housing.

The pistol style spray head of the subject invention provides a familiar and natural means of self-defense. The pistol style spray head is steadied by the inclusion of a stabilizing bar 26 beneath the trigger finger guard 24. Two safety mechanisms insure the pistol style spray head operates when necessary. Another further familiar feature of this pistol style spray head are sights 83. Preferably, the spray head of the subject invention has sights to assist the user in aiming the device. In the exemplified embodiment, the sights are traditional open sights with the bead 84 on the cap 62 of the housing and a notch 86 near the rear of the housing. In this embodiment, the rear notch of the sight is cut into the thumb tab 72 of the safety. The sights can be aligned when the thumb tab is moved forward toward the front of the housing in the unlocked position.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. A pistol style head to release spray from a pressurized cannister having a valve comprising:

a housing having a housing front, a housing rear, and a housing top, the housing comprising cannister attachment means for attaching the housing to the pressurized cannister, a trigger finger guard on the housing front, a stabilizing brace under the trigger finger guard, and a cap on the housing top;

valve engagement means, the valve engagement means comprising a tube capable of engaging a valve of the cannister, and a nozzle to direct spray released from the valve through an opening in the housing;

a trigger box, the trigger box comprising a trigger pull portion on a box front, opposing box sides, a bridge on a box top along a box rear, spurs extending from each side of the trigger box near the box top and box rear, and a bar on a box bottom along the box rear, the bar resting in a channel of the housing, wherein the nozzle of the valve attachment means is pushed through the box rear and out the box front above the trigger pull portion; and a safety comprising a thumb tab outside the housing, a pair of legs extending from the thumb tab, each leg comprising a safety pin disposed along the each leg, and the each leg terminating in a pivot that rests in saddles of the housing;

wherein to release spray from the pressurized cannister the thumb tab is pushed toward the front of the housing moving the safety pin on each leg of the safety off shelves on the end of posts in the housing allowing the spurs of the trigger box to fall onto the shelves when the trigger pull portion is pulled toward the rear of the housing and the bridge depresses the nozzle and the tube to engage the valve and release the spray.

2. The pistol style head of claim 1, further comprising a trigger block disposed within said trigger finger guard and surrounding said trigger pull portion of said trigger box.

3. The pistol style head of claim 2, wherein said trigger block has resilient fingers to hold said trigger block within said trigger finger guard.

4. The pistol style head of claim 1, wherein said cannister attachment means comprises a skirt on a bottom of said housing and resilient fingers capable of capturing a portion of said cannister between the skirt and the resilient fingers.

5. The pistol style head of claim 1, further comprising a retainer to position said tube within said housing.

6. The pistol style head of claim 5, wherein a shoulder on said tube mates with said retainer to seal said tube within said retainer.

7. The pistol style head of claim 1, wherein said housing is curved from a rear of said cap toward said housing rear.

8. The pistol style head of claim 1, further comprising sights.

9. The pistol style head of claim 8, wherein said sights comprise a bead on said cap at said housing front.

10. The pistol style head of claim 9, further comprising a notch near said housing rear.

11. The pistol style head of claim 10, wherein said notch is cut into said thumb tab of said safety.

12. A pistol style head to release spray from a pressurized cannister having a valve comprising:

a housing having a housing front, a housing rear, and a housing top, the housing comprising cannister attachment means for attaching the housing to the pressurized cannister, a trigger finger guard on the housing front, a stabilizing brace under the trigger finger guard, and a cap on the housing top;

valve engagement means, the valve engagement means comprising a tube capable of engaging a valve of the cannister, and a nozzle to direct spray released from the valve through an opening in the housing;

a trigger box, the trigger box comprising a trigger pull portion on a box front, opposing box sides, a bridge on a box top along a box rear, spurs extending from each side of the trigger box near the box top and box rear, and a bar on a box bottom along the rear of the box, the bar resting in a channel of the housing, wherein the nozzle of the valve attachment means is pushed through the box rear and out the box front above the trigger pull portion;

a first safety comprising a thumb tab outside the housing, a pair of legs extending from the thumb tab, each leg comprising a safety pin disposed along the each leg, and the each leg terminating in a pivot that rests in saddles of the housing; and a second safety comprising a trigger block disposed within the trigger finger guard surrounding the trigger pull portion of the trigger box, the trigger block held within the trigger finger guard by resilient fingers;

wherein to release spray from the pressurized cannister the second safety is removed from within the trigger finger guard, and the thumb tab is pushed toward the front of the housing moving the safety pin on each leg of the first safety off shelves on the end of posts in the housing allowing the spurs of the trigger box to fall onto the shelves when the trigger pull portion is pulled toward the rear of the housing and the bridge depresses the nozzle and the tube to engage the valve and release the spray.

13. The pistol style head of claim 12, wherein said cannister attachment means comprises a skirt on a housing bottom and resilient fingers capable of capturing a portion of said cannister between the skirt and the resilient fingers.

14. The pistol style head of claim 12, further comprising a retainer to position said tube within said housing.

15. The pistol style head of claim 14, wherein a shoulder on said tube mates with said retainer to seal said tube within said retainer.

16. The pistol style head of claim 12, wherein said housing is curved from a rear of said cap toward said housing rear.

17. The pistol style head of claim 12, further comprising sights.

18. The pistol style head of claim 17, wherein said sights comprise a bead on said cap at said housing.

19. The pistol style head of claim 18, further comprising a notch near said housing rear.

20. The pistol style head of claim 19, wherein said notch is cut into said thumb tab of said safety.

* * * * *